US011145482B2

(12) United States Patent
Erler

(10) Patent No.: US 11,145,482 B2
(45) Date of Patent: Oct. 12, 2021

(54) TARGET FOR A RADIATION SOURCE, RADIATION SOURCE FOR GENERATING INVASIVE ELECTROMAGNETIC RADIATION, METHOD OF OPERATING A RADIATION SOURCE, AND METHOD FOR PRODUCING A TARGET FOR A RADIATION SOURCE

(71) Applicant: Carl Zeiss Industrielle Messtechnik GmbH, Oberkochen (DE)

(72) Inventor: Marco Erler, Oberkochen (DE)

(73) Assignee: Carl Zeiss Industrielle Messtechnik GmbH, Oberkochen (DE)

( * ) Notice: Subject to any disclaimer, the term of this patent is extended or adjusted under 35 U.S.C. 154(b) by 0 days.

(21) Appl. No.: 16/940,174

(22) Filed: Jul. 27, 2020

(65) Prior Publication Data

US 2020/0396818 A1 Dec. 17, 2020

Related U.S. Application Data

(63) Continuation of application No. PCT/EP2019/051884, filed on Jan. 25, 2019.

(30) Foreign Application Priority Data

Jan. 26, 2018 (DE) ..... 102018201245.8

(51) Int. Cl.
*H01J 35/08* (2006.01)
*H01J 35/24* (2006.01)

(52) U.S. Cl.
CPC ..... *H01J 35/08* (2013.01); *H01J 35/24* (2013.01); *H01J 2235/086* (2013.01); *H01J 2235/1204* (2013.01)

(58) Field of Classification Search
CPC ..... H01J 2235/086; H01J 2235/1204; H01J 35/08; H01J 35/24; H01J 2235/081;
(Continued)

(56) References Cited

U.S. PATENT DOCUMENTS 5,148,462 A 9/1992 Spitsyn et al.
6,377,660 B1 * 4/2002 Ukita ..... H01J 35/112 378/143

(Continued)

FOREIGN PATENT DOCUMENTS

JP 2002313266 A 10/2002
WO WO-2008006552 A1 * 1/2008 ..... H01J 35/13

(Continued)

OTHER PUBLICATIONS

International Search Report dated May 16, 2019 international patent application PCT/EP2019/051884 on which this application is based.

*Primary Examiner* — Chih-Cheng Kao
(74) *Attorney, Agent, or Firm* — Walter Ottesen, P.A.

(57) ABSTRACT

A target for a radiation source of invasive electromagnetic radiation has at least one target element, which is configured to generate invasive electromagnetic radiation when irradiated with particles and is coupled to a substrate arrangement for dissipating heat out of the target element, wherein: the target element has a peripheral surface which forms a first part of the outer surface of the target element; the outer surface of the target element is also formed by a side surface of the target element; an extension of the side surface defines a thickness (D) of the target element; a peripheral line of the side surface forms a borderline of the peripheral surface; the target has an end face, as part whereof the side surface of the target element is exposed for irradiation with particles; and the substrate arrangement is in contact with the peripheral surface.

13 Claims, 4 Drawing Sheets

(58) Field of Classification Search
CPC ..... H01J 2235/088; H01J 35/14; H01J 2235/1262; H01J 2235/1291; H01J 35/12; H05G 1/025; H05G 1/52
See application file for complete search history.

(56) References Cited

U.S. PATENT DOCUMENTS

| | | | | |
|---|---|---|---|---|
| 8,416,920 | B2 | 4/2013 | Okumura et al. | |
| 9,543,109 | B2 | 1/2017 | Yun et al. | |
| 2012/0051496 | A1 | 3/2012 | Wang et al. | |
| 2015/0117616 | A1 | 4/2015 | Ishii et al. | |
| 2016/0351370 | A1* | 12/2016 | Yun ..... | H01J 35/10 |
| 2018/0358197 | A1 | 12/2018 | Hu | |

FOREIGN PATENT DOCUMENTS

| | | | |
|---|---|---|---|
| WO | 2014140099 | A2 | 9/2014 |
| WO | 2017092834 | A1 | 6/2017 |
| WO | 2017204850 | A1 | 11/2017 |

* cited by examiner

TARGET FOR A RADIATION SOURCE, RADIATION SOURCE FOR GENERATING INVASIVE ELECTROMAGNETIC RADIATION, METHOD OF OPERATING A RADIATION SOURCE, AND METHOD FOR PRODUCING A TARGET FOR A RADIATION SOURCE

CROSS REFERENCE TO RELATED APPLICATION

This application is a continuation application of international patent application PCT/EP2019/051884, filed Jan. 25, 2019, designating the United States and claiming priority from German application 10 2018 201 245.8, filed Jan. 26, 2018, and the entire content of both applications is incorporated herein by reference.

FIELD OF THE INVENTION

The disclosure relates to a target, a radiation source, a use of a radiation source and a method for producing a target. In particular, the disclosure relates to a target having an exposed surface of a target element. With the use of a corresponding radiation source with the target element, the exposed surface can be irradiated with particles, in particular electrons, in order to generate invasive electromagnetic radiation.

BACKGROUND OF THE INVENTION

Invasive radiation, in particular X-ray radiation, is used for industrial computed tomography applications (CT). The image quality of the resulting radiographs of the object examined is dependent, inter alia, on the power density (radiant flux density) of a particle beam (in particular of an electron beam) which, in order to generate the invasive radiation, is radiated onto a so-called target of a radiation source, in which the invasive radiation arises. The particles are decelerated in the target, as a result of which the invasive electromagnetic radiation arises as so-called bremsstrahlung. The region in which the particles interact spatially with the target is also referred to as a focal spot. The power density of the particle beam is intended to be as high as possible for many applications in order to achieve a high radiation power of the invasive radiation and thus a good image quality. However, if the particle beam has an excessively high power density, the target can be vaporized at the focal spot and thus damaged.

One possibility for avoiding such damage consists in expanding the particle beam. The focal spot on the target is then enlarged and the radiant flux density decreases. However, the larger spot size caused by this on the target corresponds to a lesser degree to a point radiation source of the electromagnetic radiation emanating from the source, reduces the image sharpness of the radiographs and thus also reduces the achievable image quality.

A smaller spot size can be employed if the power of the invasive radiation is reduced. With low power, however, known detectors for detecting the invasive radiation and for generating the radiographs of the object generate images having a low signal-to-noise ratio.

US2016/0351370 discloses an X-ray radiation source in which a plurality of regions aligned with one another are exposed to an electron beam. For this purpose, X-ray targets are formed from layers of a radiation-generating material, wherein the individual layers are each in close thermally conductive contact with a substrate. The amount of heat that can be dissipated from the X-ray target is increased as a result, which allows more intense irradiation with the electron beam.

Further technological background is found in US2018/0358197, JP2002313266 A and U.S. Pat. No. 5,148,462 A.

SUMMARY OF THE INVENTION

It is an object to provide a solution for generating invasive electromagnetic radiation which makes it possible to emit electromagnetic radiation with a high radiation power in conjunction with a small spot size.

The inventor has generally recognized that an alternative to expanding the particle beam is required. The alternative may include, in particular, improved heat dissipation of the heat that arises during deceleration of the particles from the target. Improved heat dissipation from the target enables a higher power density of the impinging particle radiation, without damage to the target occurring.

The object can, for example, be achieved by a target, a radiation source and a method according to the disclosure.

A target for a radiation source of invasive electromagnetic radiation includes at least one target element, which is configured to generate invasive electromagnetic radiation upon irradiation with particles and which is coupled to a substrate arrangement for dissipating heat from the target element. The target element furthermore has a peripheral surface and thus a surface which extends peripherally in a self-contained manner and which forms a first part of the outer surface of the target element. The outer surface of the target element is additionally formed by a side surface of the target element, wherein an extent of the side surface defines a thickness of the target element, wherein a peripheral line, and thus a marginal line, extending peripherally in a self-contained manner, of the side surface forms a marginal line of the peripheral surface. The target furthermore has an end face, as part of which the side surface of the target element is arranged in an exposed manner for irradiation with the particles. The substrate arrangement is in contact with the peripheral surface.

As mentioned, the invasive electromagnetic radiation can be X-ray radiation, in particular for industrial CT applications in which workpieces are transilluminated in order to create radiographs. The target element can generally be configured to emit bremsstrahlung in the form of X-ray radiation or invasive radiation having a different wavelength upon irradiation with a particle beam (for example in the form of an electron beam or a proton beam).

For this purpose, the target element can be made of a suitable material, such as, for example, tungsten (see below).

The target is embodied in particular as a non-transmissive target, that is, as a reflection target. Such targets are also referred to as direct emitters. The power of the particle beam (and in particular of a possible electron beam) can be 500 W, for example. A resolution of the electromagnetic radiation generated, and in particular of possible X-ray radiation, can be between 1 μm and 5 μm. The focal spot size can be between 10 μm and 200 μm and for example between 5 μm and 10 μm.

The substrate arrangement preferably includes a material having a high coefficient of thermal conductivity in comparison with metals and a high melting point. Additionally or alternatively, the material can be electrically insulating. In particular, the material can be configured to emit no electromagnetic radiation, and primarily no X-ray radiation, when the particle beam impinges on the material. Heat transfer from the target element to the material of the substrate arrangement is ensured via the substrate material being contacted with and/or connected to the peripheral surface of the target element. By way of example, it is possible to provide a direct contact between the target element and the substrate arrangement and/or an indirect contact via intermediate material for securing the target element to the substrate arrangement, such as a solder layer, for example. The substrate arrangement can furthermore include at least one substrate element that is preferably substantially block-shaped and/or extends along the target element (in particular along the entire length thereof).

The peripheral surface of the target element can be (for example in the case of a cylindrical and/or wire-shaped embodiment explained below) an outer peripheral surface extending in a curved manner at least regionally. In the case of a target element embodied in a layerlike manner and explained below, the peripheral surface can have a respective surface at the top side and underside of the target element, and also two lateral surfaces, that is, side surfaces, connecting these surfaces. To put it another way, the peripheral surface in this case can have two of the side surfaces of the substantially prismatic or parallelepipedal target layer, which are connected by corresponding bottom and/or top surfaces of the target layer. In this case the peripheral surface does not include a front and a rear side surface of the target layer, one of which is arranged in an exposed manner for irradiation with particles.

The thickness of the target element can be a layer thickness of this element or a diameter in the case of a wire-shaped embodiment. Generally, the thickness can refer to a dimension of the target element that is to be measured in a direction extending substantially perpendicularly to an impinging particle beam. The thickness can delimit the focal spot. This is the case if the particle beam has a larger dimension than the target element in the direction of the thickness.

The end face of the target can likewise extend substantially perpendicularly to an impinging particle beam or else in an inclined manner with respect thereto. Furthermore, the end face can be embodied as curved, and in particular convexly curved, wherein the curvature can generally extend in the direction of the impinging particle beam (that is, toward the particle beam). The exposed side surface of the target element can be aligned with the other portions of the end face and/or the entire end face of the target can be substantially planar. An exposed side surface means that the latter is exposed for irradiation with the particles and/or is not shielded by further materials or elements.

The above-defined structure of the target enables particle irradiation of preferably exclusively a single side surface. By way of the longitudinal extent of the target element in the depth direction and by way of the peripheral surface of the target element, the heat that arises during irradiation can be dissipated into the depth and be guided into the substrate arrangement. Preferably, a large portion of the peripheral surface, for example more than 90% and preferably more than 95%, is in contact with the substrate material of the substrate arrangement. In any case in which, as preferred, the peripheral surface is larger than the exposed side surface, the energy input effected by way of the exposed side surface can be transported away by virtue of a comparatively large contact area directly from the target element into the substrate arrangement, without the energy input resulting in damage to the target. The power density of the impinging particle beam can thus be increased, without the particle beam having to be expanded. Furthermore, the structure according to the disclosure makes it possible that even in the case of incipient wear at the exposed side surface of the target element (for example in the case of erosion) there is still enough material volume available to avoid changes in the intensity of the electromagnetic radiation generated. An arbitrary amount of material can be situated in the depth direction, that is, in a direction transversely with respect to the surface of the side surface, since a substrate as carrier of the target material is not required in the depth direction. The lifetime and the available operational period of the target can thus be increased.

In the case of a wire-shaped target element, for example, the target element can be dimensioned with a length in the depth direction such that the peripheral surface is larger than the exposed side surface. The latter can be shaped like a cross-sectional area of the wire-shaped target element. In the case where the target element is embodied in a layerlike manner, the exposed side surface can likewise be shaped like a cross-sectional area and/or have a comparatively narrow (in the thickness direction) elongate (in the width direction) extent. On account of a large ratio between width and thickness of the exposed side surfaces, only a small dimension in the depth direction is required, such that the peripheral surface of such a target layer is larger than the exposed side surface.

In accordance with a further embodiment, the target element has a polygonal basic contour having different side lengths. In this case, the side surface defines in particular a side of the basic contour which does not have the largest side length. The basic area thus has sides having a larger length, in particular in the depth direction. In particular, a rectangular basic area can be involved.

In one configuration, the basic contour is rectangular and has two longer sides and two shorter sides. In this case, the exposed side surface preferably forms or contains the shorter side.

As mentioned, according to the disclosure, the target element is embodied in a layerlike manner. In this case, the exposed side surface of the target element defines a thickness and a larger width of the target element in comparison with the thickness, that is, the target element has a larger width in comparison with the thickness, wherein a total length of the peripheral line is defined by the thickness and by the width. In the exemplary case of a rectangular side surface, the total length of the peripheral line is equal to double the thickness plus double the width. However, the configuration with a layerlike target element is not restricted to a rectangular side surface. The substrate arrangement is in contact with the peripheral surface, preferably over the whole area, at sides thereof which are opposite one another in the direction of the thickness. Therefore, heat that arises in the target element is transported away rapidly via the correspondingly large total contact area to the substrate arrangement. However, in the case of other forms of the target element, too, such as, for example, the wire-shaped form that will also be described below, it is preferred for the substrate arrangement to be in contact with the peripheral surface at sides thereof that are opposite one another, in particular over the entire length of the target element in the depth direction. In the case of the layerlike target element, it is preferred for the substrate arrangement to be in contact with the peripheral surface over the whole area, specifically preferably partly indirectly by way of solder material and partly directly by way of press contact. Optionally, the whole-area contact excludes only the side surfaces of the peripheral surface, that is, those side surfaces which define the extent of the target element in the depth direction and the thickness direction.

The thickness of the target element, and in particular a possible layer thickness thereof, can generally be chosen to be smaller than a thickness of the substrate arrangement, wherein the thickness of the substrate arrangement and the thickness of the layer are to be measured parallel to one another. In this case, any of the thickness dimensions mentioned above can extend parallel to or in the end face of the target and/or substantially perpendicularly to a path direction or beam axis of the impinging particle beam.

The layerlike target element can have a constant layer thickness in the depth direction.

According to the disclosure, at the exposed side surface, the thickness of the layerlike target element increases in the width direction. In particular, the thickness can increase continuously and for example linearly in the width direction, such that the side surface is embodied in a trapezoidal fashion. More generally, at the exposed side surface, the layerlike target element can have a thickness that varies as viewed along its width, for example a layer thickness that increases or decreases continuously over the entire extent in the width direction or a part thereof. Depending on the partial region of the exposed side surfaces onto which the impinging particle beam is directed, the focal spot size can thus vary if the cross section of the particle beam impinges on a partial region of the end face of the target in which an edge of the exposed side surface is situated. The material of the target beyond the edge of the target element does not contribute to the generation of invasive radiation.

In accordance with a further embodiment, the target element is embodied in a cylindrical fashion, wherein the side surface forms an end surface of the target element that is elliptic or circular in a front view of the target element. In this context, the target element can have a basic area which is circular or oval, for example, and a material volume extending along a longitudinal axis of the target element. The latter can in turn define a peripheral surface of the target element. In one variant, the target element is embodied in a wire-shaped manner, wherein it can once again generally be shaped in an elongate manner and preferably has a circular cross section. The exposed side surface can be shaped in accordance with a cross-sectional shape of the cylindrical target element and/or define the shape. In one variant, the exposed side surface is circular and defines a diameter and thus a thickness of the wire-shaped target element. The dimensions of the diameter can be for example, between 3 μm and 200 μm and be for example up to 10 μm or up to 20 μm.

The wire-shaped target element can be received at least in portions in a receiving structure of the substrate arrangement. The receiving structure can include a groove having, for example, a V-shaped or rectangular cross-sectional shape. In the case of a multipartite embodiment of the substrate arrangement as explained below, a corresponding receiving structure (for example a groove) can be provided in a first substrate element, wherein a second substrate element closes the groove at least in portions (for example closes in portions the cross section of the groove that is open at least on one side). Alternatively, the receiving structure can include a hole, which can extend in particular substantially transversely with respect to the end face and/or into which the target element is inserted.

An embodiment provides for the target to include a plurality of target elements having different thicknesses. The target elements can be produced from an identical material and/or have substantially identical lengths, for example as viewed orthogonally to the end face of the target. The target elements can in turn each include exposed side surfaces in an end face of the target and each be configured to emit invasive electromagnetic radiation upon irradiation with particles, the invasive electromagnetic radiation being usable for creating object radiographs. In order to vary the focal spot size, the electron beam can alternate between the target elements or, to put it another way, irradiate target elements with different thicknesses. The exposed side surfaces can be arranged along a common and preferably rectilinear line. This makes it possible for the electron beam to be directed onto the different target elements in a simple manner, for example via a linear relative movement of target and electron beam or a relative rotation during which the electron beam is moved linearly over the target.

In this context, provision can furthermore be made for the target to have a plurality of wire-shaped target elements having different thicknesses or diameters, which are preferably in turn arranged in a common row within the end face of the target and are exposed. The focal spot size can be varied in this case by virtue of the fact that irradiation with the particle beam alternates between the wire-shaped target elements (that is, successively different target elements are irradiated).

An embodiment provides for the substrate arrangement to enclose the target element at least in portions. This can be effected by a wire-shaped target element being received in a receiving structure (for example in a groove) in the manner outlined above and the receiving structure being covered with a further element of the substrate arrangement. To put it more generally, the target element can be received between individual substrate elements of the substrate arrangement in a sandwichlike manner.

In a variant, the substrate arrangement includes a first and a second substrate element, which receive between them at least one portion of the target element. In this case, the substrate elements can preferably be pressed against one another, for example via mechanical securing or clamping elements or by a heat dissipating element or heat dissipating arrangement, explained below. The substrate elements can each be embodied in a block-shaped fashion and/or be embodied in such a way that the target element bears against them as much as possible over the whole area (for example bears against them via at least one substantially complete bottom or top surface). In a variant, the substrate elements extend along the entire length of the target element in the depth direction.

An embodiment provides for the substrate arrangement to be received in a heat dissipating element or in a heat dissipating arrangement, which is preferably connected or connectable to a cooling device. The cooling device can be provided externally in relation to the target and can be for example a part of a radiation source explained below. The heat dissipating element or the heat dissipating arrangement can be embodied in a block-shaped or tubular fashion and/or include a receiving portion for the substrate arrangement. Additionally or alternatively, the heat dissipating element or the heat dissipating arrangement can define a cavity into which the substrate arrangement is inserted and/or pushed. In the case of a plurality of substrate elements, the heat dissipating element or the heat dissipating arrangement can be configured, for example, by exerting a press-on or compressive force, to hold the substrate elements together and/or to press them against one another. Generally, it is possible to provide for bearing between the heat dissipating element (or the heat dissipating arrangement) and the substrate arrangement at least in portions in order to enable a good heat transfer to the heat dissipating element or the heat dissipating arrangement. For connection to the cooling device, the heat dissipating element or the heat dissipating arrangement can include a suitable connection region. Additionally or alternatively, the heat dissipating element or the heat dissipating arrangement can include at least one cooling duct into which a coolant is able to be introduced.

The substrate arrangement, too, can be connected or connectable to a cooling device. By way of example, the substrate arrangement can likewise include a cooling duct and/or a receiving region in which a cooled line of the cooling device is able to be received. In a variant, a coolant of the cooling device flows and/or washes around the substrate arrangement at least in portions.

In accordance with an embodiment, the target has a substrate arrangement including diamond or a diamond-containing material, and/or the target has a target element which is made of tungsten, and/or the heat dissipating element or the heat dissipating arrangement includes copper.

In the region of the end face, regions of the target element that lie away from the exposed side surface, and in particular the side surface of the substrate arrangement, can be covered with a material layer. The material of this layer can be chosen in such a way that charging of electrons in the substrate arrangement is substantially suppressed or at least limited. The generation of an opposing electric field with respect to the electron beam can be avoided as a result. In particular, this layer can consist of a metallic material, a semiconductor material or carbon.

As an alternative to the above approaches of irradiating a side surface in the target, a target is furthermore disclosed in which tungsten particles are introduced into a light metal matrix. In the context of cooling of such a composition, the tungsten particles can deposit at an underside of the target. The particle density should be chosen in such a way that the particles occupy a proportion of approximately 10% of the area of the underside. The underside can then be irradiated with an electron beam in order to generate X-ray radiation. However, the melting point of the light metal matrix can limit the beam power of the electron beam that is usable in this case.

The disclosure furthermore relates to a radiation source for generating invasive electromagnetic radiation, including a target; a particle beam source configured to direct a particle beam onto the target; and a positioning device configured to orient the target and the electron beam relative to one another in a variable manner, such that that surface region of the target onto which the particle beam is directed is variable. The particle beam can once again include electrons. The particle beam source can include a glow wire for emitting the electrons. Via the positioning device, the particle beam and the target can be rotated for example, relative to one another, for example about an axis extending perpendicularly to the particle beam. In a variant, the target is rotatable relative to the particle beam, wherein the axis of rotation can once again extend orthogonally to the particle beam.

Via the positioning device, the particle beam can be directed onto different surface regions of the exposed side surface of the target element. In the case of a constant thickness of the target element, this can be used to compensate for local wear (that is, the particle beam can, if necessary, be directed onto a portion that is not yet worn). In the case of a varying thickness (for example in the case of a trapezoidal side surface of the target element), the focal spot size can also be varied via the positioning device.

Moreover, the disclosure relates to a method of using a radiation source of the type described above, including the following steps:

- directing a particle beam onto a first surface region of the end face of the target;
- varying a relative orientation of the target and the particle beam in such a way that the particle beam is directed onto a second surface region of the end face of the target; wherein the first and second surface regions of the end face have regions—having different thicknesses—of exposed side surfaces of one or more target elements. The sequence of steps is variable over time in this case. It goes without saying for example, that the last two steps are also able to be carried out in the opposite order and/or in a manner overlapping in time.

In the case of just one target element, the regions having different thicknesses can be defined by a trapezoidal shape of an exposed side surface of the target element. In the case of a plurality of target elements, the latter can each have mutually different thicknesses and thus each define by themselves one of the regions having different thicknesses within the end face of the target. This can be achieved for example, by the target including a plurality of wire-shaped target elements having mutually different diameters.

The method can generally include any further step and any further feature in order to provide all of the operating states, effects and/or interactions discussed above and below. In particular, the method can include a step of cooling the substrate arrangement or a possible heat dissipating element or heat dissipating arrangement.

In addition, the disclosure relates to a method for producing a target for a radiation source of invasive electromagnetic radiation, in particular a target in one of the configurations described in this description. In accordance with the method,

- at least one target element is provided, which is configured to generate invasive electromagnetic radiation upon irradiation with particles,
- the target element has a peripheral surface forming a first part of the outer surface of the target element,
- the peripheral surface is brought into contact with a substrate arrangement for dissipating heat from the target element,
- the outer surface of the target element is additionally formed by a side surface of the target element, wherein an extent of the side surface defines a thickness of the target element, and wherein a peripheral line of the side surface forms a marginal line of the peripheral surface,
- the side surface of the target element is arranged in an exposed manner for irradiation with the particles and forms a part of the end face of the target.

Features of configurations of the method are evident from the description of configurations of the target.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
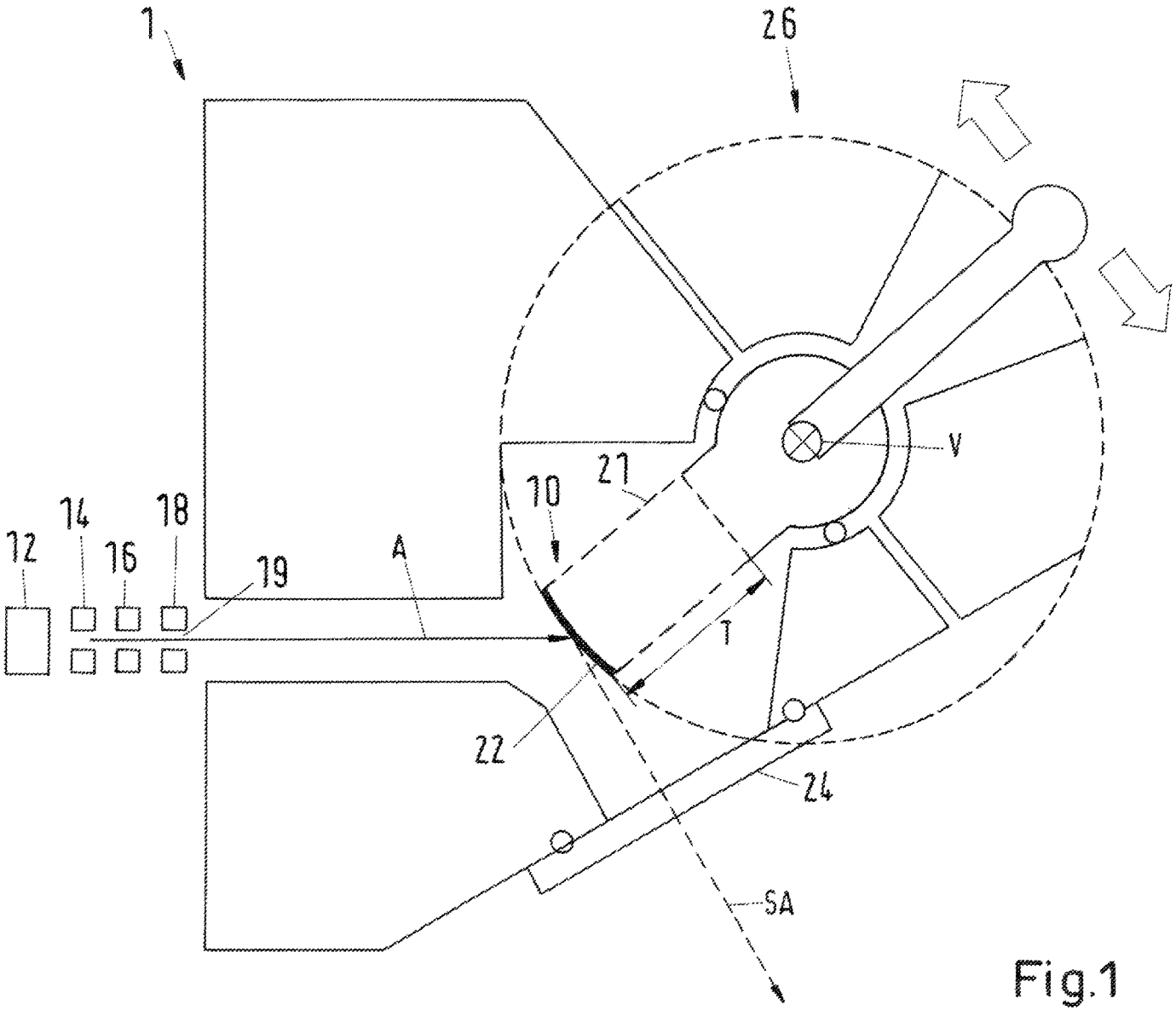
FIG. 1 schematically illustrates a plan view of a radiation source according to the disclosure, including a target according to the disclosure.

FIG. 1 shows a plan view of a radiation source 1 according to the disclosure, which includes a target 10 according to the disclosure and with which a method according to the disclosure is able to be carried out.

The radiation source 1 includes an electron beam source 12 indicated schematically. The electron beam source 12 forms a particle beam source for emitting electrons. The electron beam source 12 is configured to emit particles in the form of electrons along a particle beam axis A and to direct them onto the target 10. Various coils for orienting and focusing the electron beam are positioned along the particle beam axis A. To put it more precisely, as viewed proceeding from the electron beam source 12 and in the direction of the target 10, firstly a first and a second beam deflecting unit 14, 16 are provided, via which the orientation of the beam axis A is inherently variable. Furthermore, a focus coil 18 is provided, which includes an aperture 19 and via which a focal plane of the electron beam is able to be set. In a known manner, the focal plane can be positioned in the region of the target 10 or slightly in front of or behind it. Furthermore, the illustration does not show that a copper tube surrounding the beam axis A can be provided at least in the region of the beam deflecting units 14, 16 and the focus coil 18.

The target 10 is likewise shown in plan view in FIG. 1. A region 21 of extent in which the target elements are arranged in particular in accordance with one of the embodiments below is indicated by dashed lines. An extent of the depth T of the target is likewise marked. This generally coincides with a longitudinal extent of the target elements explained below.

The target 10 has a slightly convexly curved end face 22 facing the electron beam. As explained below, the end face 22 is also inclined relative to the electron beam and also relative to the plane of the drawing. If the electron beam impinges on the end face 22 and penetrates into the material of the target 10, it is decelerated, whereupon X-ray radiation is emitted. An X-ray used beam cone emerges along an axis SA through a stop 24 into the surroundings and, after radiating through an object, is incident on a detector device, not illustrated, in order to generate a radiograph of the object.

The target 10 is furthermore coupled to a positioning device 26 (or else adjustment mechanism). The positioning device 26 makes it possible to rotate the target 10 about an axis V that is perpendicular to the plane of the drawing. The end face 22 of the target 10 can thus also be rotated relative to the electron beam. As can be inferred from the view in FIG. 1, for example, given a uniform orientation of the electron beam axis A, the electron beam can thus be directed onto different regions of the end face 22 of the target 10 and be moved in particular along a line along the end face 22 (for example in FIG. 1 from top left to bottom right or vice versa). As explained in even greater detail below, such a possibility for positioning is expedient in order to react to local wear (for example erosion) of the target 10. Likewise, in specific embodiments, it is possible to vary the focal spot size by this means. Additionally or alternatively, it is also possible, however, according to the disclosure to achieve a slight change in the position of the focal spot by way of changing the orientation of the electron beam axis A (for example via the corresponding beam deflecting units 14, 16 and/or via the focus coil 18 in the context of so-called beam alignment).

As can furthermore be derived from the illustration in FIG. 1, the curved end face 22 of the target 10 ensures that a uniform distance between the end face 22 and the electron beam source 12 is maintained in the direction of the electron beam axis A even in the event of a rotation about the axis V. This has the consequence that the arrangement of the end face 22 relative to the focal plane of the electron beam does not change significantly and the focal spot size also remains substantially constant.

Figure 2:
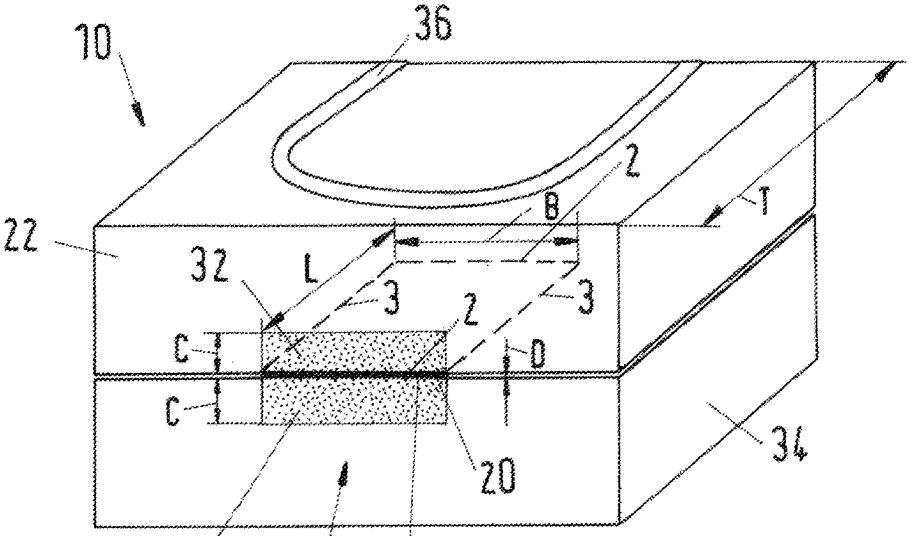
FIG. 2 illustrates a perspective individual illustration of a target in accordance with a first embodiment in particular for use in the radiation source from FIG. 1.

FIG. 2 shows a schematic perspective individual part illustration of a target 10 for use in particular in the radiation source 1 from FIG. 1. In this case, the target 10 is embodied in accordance with a first embodiment. It includes a layerlike target element 20, an anode element in the case of an electron beam, which includes tungsten. The target element 20 is configured to emit bremsstrahlung in the form of X-ray radiation upon irradiation with electrons.

The target element 20 is received in a substrate arrangement 28 consisting of diamond produced for example, via a CVD (chemical vapor deposition) method. The substrate arrangement 28 includes a first substrate element 30 and a second substrate element 32. The surfaces of the target element 20 that are at the top and bottom in the illustration in FIG. 2 are each in mechanical contact with the substrate arrangement 28, specifically preferably in contact in each case over the whole area. Therefore, the target element 20 is arranged between the two substrate elements 30, 32. In one specific configuration, the target element 20 is applied by deposition of its material on the first substrate element 30, and the second substrate element 32 is pressed against that surface of the target element 20 which is at the top in the illustration. The deposition of the material of the target element 20 has the advantage that a connection to the first substrate element 30 with good thermal conductivity can be created as a result. In addition, the deposition of material is well suited to producing a layerlike target element. After the deposition of the material, the shape of the deposited material can also be altered, for example, in order to produce the target element illustrated in FIG. 3.

The substrate arrangement 28 itself is received in a heat dissipating arrangement 34, for example, composed of copper, which is in turn embodied in a bipartite fashion. To put it more precisely, the heat dissipating arrangement 34 encloses the substrate arrangement 28 and bears against the substrate arrangement 28 over a large area at the largest outer surfaces of the substrate arrangement. Furthermore, at least one cooling duct 36 is provided in the heat dissipating arrangement 34, a coolant for transporting heat away flowing through the at least one cooling duct. The cooling duct 36 is connected to a cooling device (not illustrated) of the radiation source 1.

In FIG. 2 and in the subsequent figures, for the sake of simpler illustration, the target 10 is not provided with a curved end face 22, but rather with a planar end face 22. This analogously applies to the target element 20 and the substrate arrangement 28. The curved end face 22 is advantageous for the reasons mentioned above, although the disclosure is not restricted thereto, and so the end face 22 can also be embodied in a planar fashion.

The above-explained basic construction of the target 10 is explained in greater detail below. Firstly, FIG. 2 reveals that in the end face 22 facing the electron beam, the substrate arrangement 28 and also the target element 20 are in each case exposed and thus undergo exposure. The illustration does not show that the corresponding front surfaces of the substrate elements 30, 32 shown in FIG. 2 can also be shielded in each case with a suitable material layer (for example composed of carbon) in order to prevent an opposing electric field from arising upon irradiation with the electron beam.

The target element 20 is embodied in a layerlike manner. In the embodiment shown, the layer thickness D is constant in this case. Furthermore, the layer thickness D is chosen to be comparatively thin and is for example, at least 10 μm, preferably at least 20 μm, and/or for example, at most 200 μm, preferably at most 100 μm. It is evident that a respective thickness C of the substrate elements 30, 32 exceeds the layer thickness D of the target element 20 by a multiple, for example, at least by five-fold and preferably at least by ten-fold. All of the thickness dimensions C, D explained above here extend perpendicularly to the depth direction in which the target element extends with a depth T. If the target 10 is used in an arrangement as shown in FIG. 1, the electron beam axis A impinges on the exposed end face of the target element 20 in a manner inclined or angled with respect to the depth direction.

Furthermore, FIG. 2 indicates by dashed lines the fact that the target element 20 extends with a length L into the target 10. The length L corresponds to an above-explained depth T of the target 10 (see FIG. 1). The length L is preferably at least 10 μm, at least 20 μm or at least 40 μm, particularly preferably at least 100 μm. In practice, the length can be for example, 200 μm. Alternatively or additionally, the length L can be greater than the layer thickness D by at least a factor of 3 or 5, preferably by at least a factor of 10.

The width B is preferably at least 1 mm or at least 2 mm, particularly preferably at least 4 mm, and in practice can be for example, 5 mm. Therefore, the width B can be greater than the layer thickness D in particular at least by a factor of 20, 50 or 100. Consequently, it is possible to limit the size of a focal spot in the direction of the layer thickness D, while in the direction of the width B a large region is available for the focal spot, for example, for generating X-ray radiation. The size of the focal spot in the direction of the width B can at any time be significantly smaller than the width B. For example, the size of the focal spot in the direction of the width B can be greater than 10 μm or 20 μm and/or less than 200 μm or 100 μm and be for example, 60 μm. The width B can be greater than the size of the focal spot in the direction of the width B for example, at least by a factor of 5, 10 or 50.

The target element 20 is thus received in the substrate arrangement 28 along its entire length L, wherein the substrate arrangement 28 is likewise received in the heat dissipating arrangement 34 along its entire length. "Received" means, in particular, that the surfaces of the mutually adjoining layers of the target element and of the substrate arrangement are in contact with one another over the whole area. The resulting large-area bearing regions enable comprehensive heat exchange between these elements and, in particular, dissipation of heat from the target element 20 into the substrate arrangement 28 and from the latter into the heat dissipating arrangement 34.

In the embodiment, the target element 20 furthermore has a substantially rectangular basic contour or, to put it another way, a substantially rectangular basic area. The latter includes two shorter sides 2 and two longer sides 3, which respectively run parallel, as shown by the enlarged illustration only of the target element 20 in FIG. 2A. One of the shorter sides 2, namely the side at the front in FIG. 2 and at the front on the left in FIG. 2A, here has an exposed side surface 38 arranged within the end face 22 of the target 10 and exposed for irradiation with electrons or other particles. The side surface 38 defines the thickness D and the larger width B in comparison therewith of the layer-shaped target element 20.

Figure 2A:
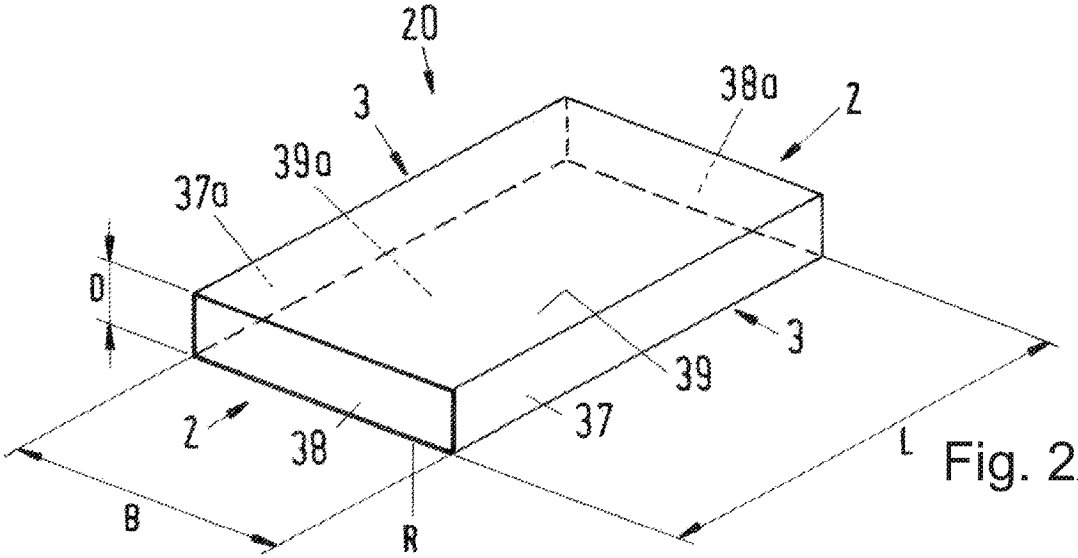
FIG. 2A illustrates a perspective schematic illustration of a target element in accordance with the embodiment shown in FIG. 2.

On account of the layerlike configuration of the target element 20, the latter can be embodied in a parallelepipedal fashion (as illustrated in FIG. 2A) or in a prismatic fashion. The exposed side surface 38 and also a further side surface 38*a* opposite it can thus be interpreted as a top surface and a bottom surface of this parallelepiped or prism. These side surfaces 38, 38*a* adjoin outer surfaces 39, 39*a* of the target element 20, which, in the illustration in FIG. 2A, lie at a top side and at an underside of the target element 20, cf. FIG. 2A. A side surface 37 and a side surface 37*a* opposite it extend perpendicularly to the outer surfaces 39, 39*a* and to the exposed side surface 38 and the side surface 38*a* opposite it. The side surfaces 37, 37*a* and the outer surfaces 39, 39*a* together form a peripheral surface extending peripherally in a self-contained manner and enclosing the material volume of the target element 20 in the sense of a cavity having a rectangular cross section. A marginal line R of the peripheral surface that extends peripherally in a self-contained manner at a side forms a peripheral line of the exposed side surface 38. The marginal line R and the peripheral line are thus identical. If the target element 20 is embodied as a parallelepiped, the outer surface 39 at the top side and the outer surface 39*a* at the underside extend orthogonally to the end face 22 of the target 10. The surface area of the peripheral surface is preferably greater than the surface area of the exposed side surface 38 by at least a factor of 10, preferably by a factor of 50 or particularly preferably by a factor of 100.

This has the consequence that a comparatively small proportion of the material of the target element 20 is exposed for irradiation with the electrons and that, by contrast, a correspondingly large proportion of material adjoins and remains at the substrate material of the substrate arrangement 28 in order to dissipate heat directly into the substrate arrangement 28 and to compensate for possible erosion of the target element 20.

This relationship is furthermore elucidated by closer consideration of the substrate arrangement 28. As mentioned, the substrate elements 30, 32 of the substrate arrangement 28 are embodied substantially in a block-shaped manner and are embodied with a larger thickness C in comparison with the target element 20. It is evident that a first, lower substrate element 30 in FIG. 2 bears against an underside of the target element 20, while a second, upper substrate element 32 bears against a top side of the target element 20. Here the substrate elements 30, 32 extend into the target 10 in each case with a length analogous to the target element 20. This has the consequence that the underside of the target element 20 bears against the substrate element 30 over the whole area and the top side of the target element 20 bears against the substrate element 32 over the whole area. A focal spot position at the side surface 38 and direct dissipation of the heat into the first substrate element 30 and the second substrate element 32 are thus achieved.

In order to couple the substrate arrangement 28 and the target element 20, the target element 20 can be soldered to one of the substrate elements 30, 32, in particular using an already known solder material including copper, silver, gold or tin and nickel, for example. The remaining substrate element 30, 32 can then be pressed onto the respectively remaining top side or underside of the target element 20. A corresponding press-on force can be effected by way of mechanical securing or clamping means (not illustrated). The latter can also be provided for fixedly clamping the two parts of the bipartite heat dissipating arrangement 34 against one another, wherein a corresponding press-on force is able to be transmitted from the heat dissipating arrangement 34 to the substrate elements 30, 32 as well.

Finally, it should be pointed out that in the end face 22 the exposed (or optionally coated) surfaces of the substrate elements 30, 32 of the heat dissipating arrangement 34 and also the exposed side surface 38 of the target element 20 can be aligned with one another, but this is not absolutely necessary. The end face 22 of the target 10 can thus have a substantially smooth surface, wherein provision can also be made of a curvature—not illustrated separately in FIG. 2—of the entire end face 22 or only of the side surface 38 in accordance with the plan view from FIG. 1.

As explained, the target element 20 is embodied with a constant thickness D corresponding to a height of the side surface 38 in the illustration in FIG. 2 and FIG. 2A. In particular, the thickness D is constant along a width B (see FIG. 2A) of the side surface 38, the width B extending transversely with respect to the length L of the basic area of the target element 20. A second embodiment—deviating therefrom—of a target 10 is explained below with reference to FIG. 3. In this case, the basic structure of the target 10 substantially corresponds to that from FIG. 2, with the exception of the deviations explained below.

Figure 3:
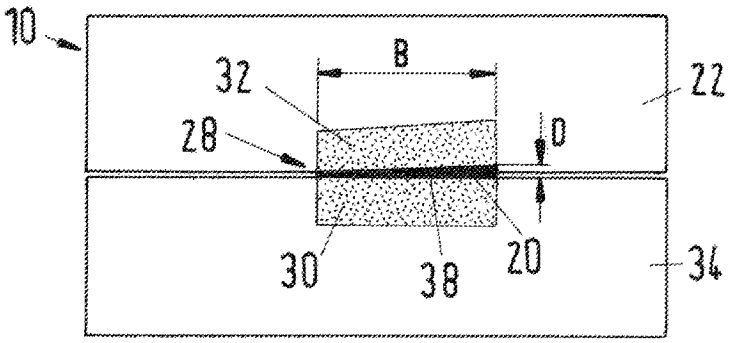
FIG. 3 shows a front view of a target in accordance with a second embodiment, which is an embodiment according to the disclosure, in particular for use in the radiation source from FIG. 1.

FIG. 3 shows a front view of the end face 22 of the target 10 in accordance with a second embodiment. In this case, analogously to the plan view from FIG. 1, the end face 22 can be embodied as convexly curved altogether or only in the region of the exposed side surface of the target element. Furthermore, the end face can be embodied with a planar surface and again includes corresponding end faces of the in turn bipartite heat dissipating arrangement 34, of the two substrate elements 30, 32, which receive a target element 20 in a sandwichlike manner, and also an exposed side surface 38 of the target element 20. The target element 20 is in turn embodied in a layerlike manner and is rectangular (not discernible in FIG. 3) in plan view (corresponding to FIG. 1). The exposed side surface 38 in turn forms a shorter side of this rectangle.

In contrast to the previous embodiment, however, a layer thickness D of the target element 20 is not constant along the width B of the target element 20. Instead, it varies, with the result that a cross-sectional shape of the target element 20, and thus a shape of the exposed side surface 38, is trapezoidal, as is discernible in FIG. 3. To put it more precisely, it is evident in FIG. 3 that the layer thickness D increases from left to right and thus along the width B of the exposed side surface 38 and even increases continuously or linearly in the embodiment shown. Depending on the portion of the exposed side surface 38 onto which the electron beam is directed, the electron beam thus impinges on a region of the target element 20 having a differing thickness. This region of interaction or region of impingement of the electron beam on the target element 20 is also referred to as a focal spot. By directing the electron beam onto different portions of the exposed side surface 38, it is thus possible to vary the focal spot size, which will be explained in even greater detail below. Changing the orientation of the electron beam relative to the target 10 can once again be effected via the positioning device 26 from FIG. 1.

The generation of X-ray radiation is explained in greater detail below with reference to FIG. 4A and FIG. 4B. In this case, FIG. 4A and FIG. 4B contain analogous illustrations, but a target 10 in accordance with the prior art is used in FIG. 4A and a target according to the disclosure in accordance with the second embodiment from FIG. 3 is used in FIG. 4B.

Figure 4B:
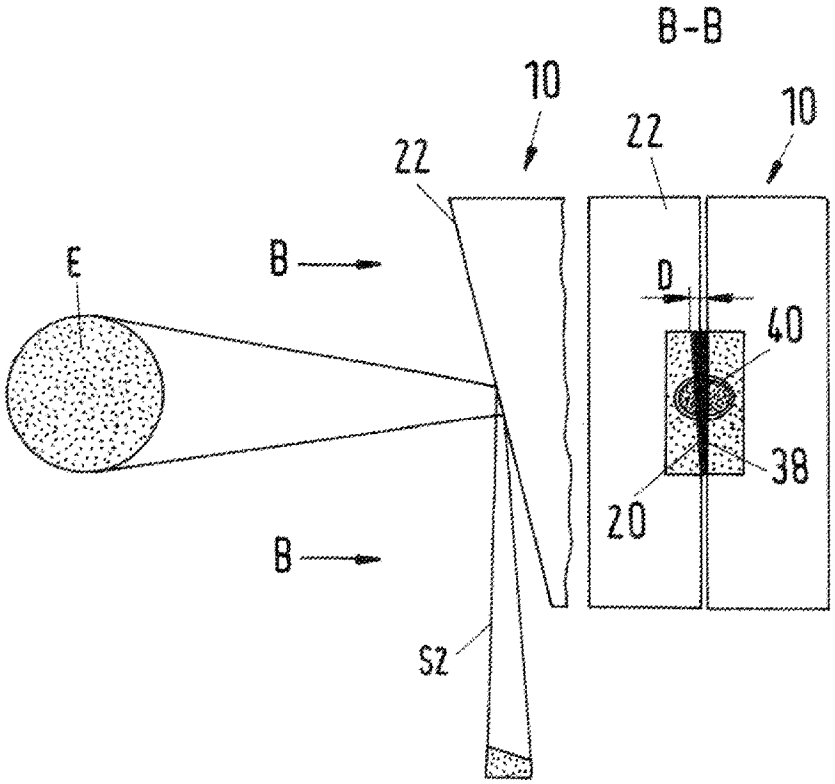
FIGS. 4A, 4B illustrate schematic views for elucidating focal spot delimitation in the case of a target in accordance with the prior art (FIG. 4A) and in the case of a target according to the disclosure (FIG. 4B)
Figure 4A:
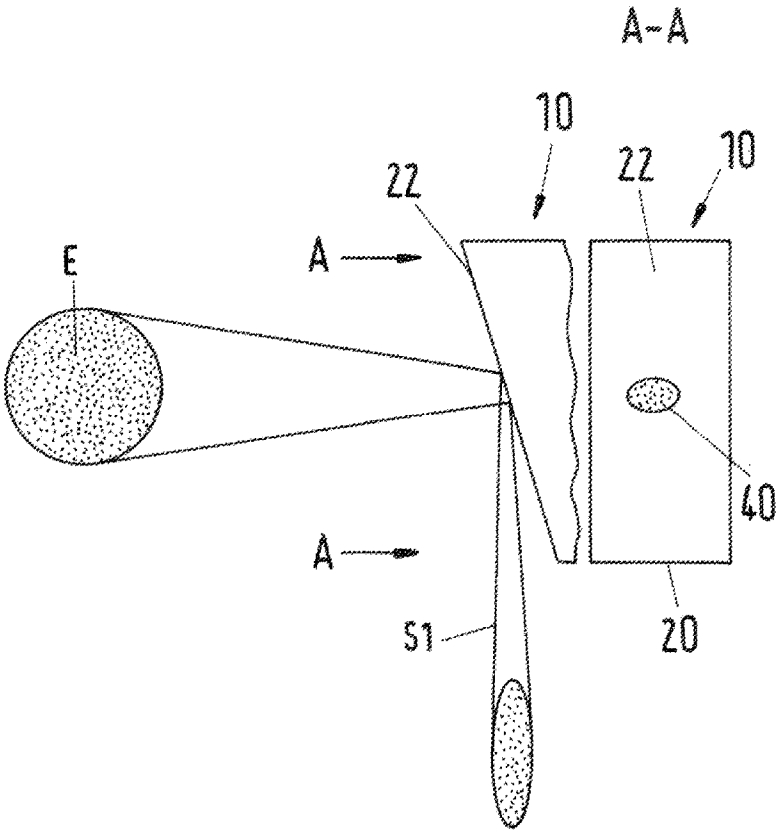

Referring firstly to FIG. 4A, the left-hand region of FIG. 4A shows a plan view of a part of the target 10 on whose end face 22 an electron beam E having for example, a circular cross section impinges. The cross section of the electron beam E and also the cross section of the resulting X-ray beam, the arising of which will also be described, are illustrated in a manner rotated into the plane of the figures. The right-hand region of FIG. 4A shows a side view from the left along A-A.

In the case of this embodiment in accordance with the prior art, the end face 22 is formed by an anode material (that is, target material suitable for generating invasive radiation) over the whole area. This can be achieved, for example, by virtue of the fact that a corresponding target element 20 is embodied as a layer, but this layer completely covers an underlying substrate end face of the target 10 and is applied thereto areally.

The electron beam E impinges on the inclined end face 22 in an elliptic region of impingement or interaction, thus giving rise to the elliptically shaped focal spot 40 illustrated on the right in FIG. 4A. As a result of the interaction of anode material and electron beam E, an X-ray beam S1 having a likewise elliptic cross section filled over the whole area is emitted (see FIG. 4A, lower region).

The illustration in FIG. 4B shows, in its left-hand region, a plan view of a target 10 in accordance with FIG. 3. FIG. 4B shows, in a manner analogous to FIG. 4A, the impingement of an electron beam E having a circular cross section on an inclined end face 22 of the target 10. In this case, too, the region of impingement of the electron beam E on the target 10 is elliptic on account of the inclination of the end face 22. Since the material of the target element converts the impinging electron energy into X-ray radiation with significantly higher efficiency than the substrate elements 30, 32, X-ray radiation is emitted in the region of the focal spot 40 only in the zone of the target element. Therefore, lateral marginal regions are trimmed from the elliptic focal spot 40, with the result that only a trapezoidal partial region remains as focal spot for generating X-ray radiation. The radiation in the elliptic region of impingement thus generates X-ray radiation only in a trapezoidal partial region of the region of impingement since the side surface 38 of the target element 20 is exposed only in the trapezoidal partial region. The right-hand region of FIG. 4B illustrates a front view of the target 10 along the arrows B-B in the left-hand region of FIG. 4B. This view corresponds to the front view of the embodiment in accordance with FIG. 3. By virtue of the layer thickness D that is not constant in the width extent in this embodiment, the focal spot 40 is thus limited in one dimension (namely in the dimension of the layer thickness D). This is advantageous since, by directing the electron radiation onto regions having different thicknesses of the exposed side surface 38 of the target element 20, it is possible to set a size of the resulting focal spot 40. The target element 20 emits an X-ray beam S2 having a cross-sectional area that is smaller than the cross-sectional area of the X-ray beam S1 in accordance with the prior art, cf. FIG. 4A. This is advantageous since a higher resolution is thus achievable (cf. FIG. 4B, left-hand region).

In summary, it becomes clear from FIG. 4B that a relatively small cross-sectional area of the emitted X-ray radiation S2 is achievable with the target according to the disclosure. This is accomplished by irradiation of the exposed side surface 38 of the target element 20 in accordance with the embodiment in FIG. 4B, instead of irradiation of a target element 20 in accordance with the prior art, in which the focal spot 40 is not limited at all in the region of impingement of the irradiation (see FIG. 4A). However, since a comparatively large material volume is available by way of the above-explained layer-shaped extent of the target element 20 into the target 10, it is possible to transport away heat that arises with sufficient power from the target element 20. Consequently, the electron beam E does not have to be significantly expanded or even partially stopped down in order to avoid damage to the target element 20. As a result, therefore, a small cross-sectional area of the emitted X-ray radiation is made possible while maintaining a high power density.

Figure 6:
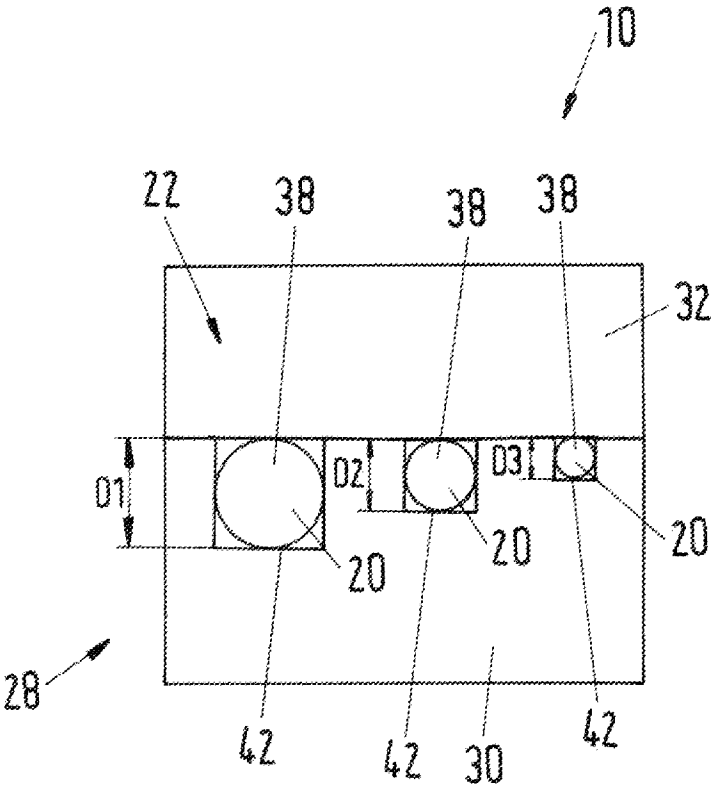
FIG. 6 illustrates a front view of a target in accordance with a fourth embodiment for use according to the disclosure in the radiation source from FIG. 1.
Figure 5:
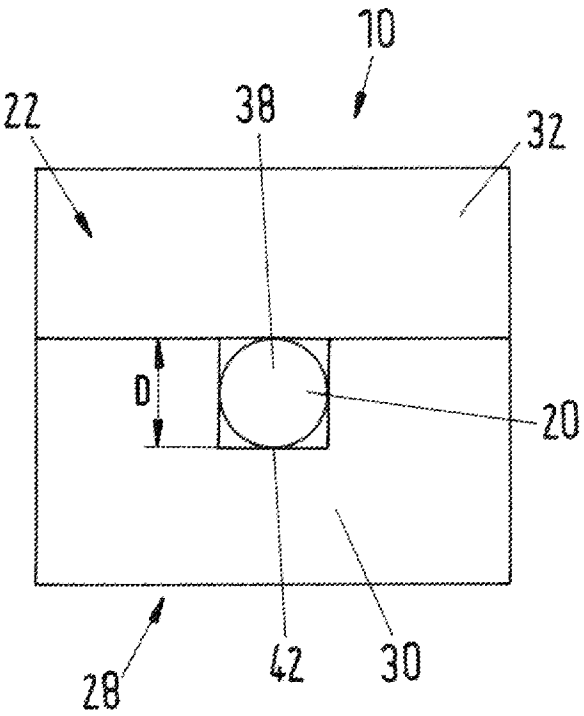
FIG. 5 illustrates a front view of a target in accordance with a third embodiment for use in the radiation source from FIG. 1.

FIG. 5 and FIG. 6 show further embodiments of a target 10 for use in a radiation source 1 from FIG. 1. The illustrations each show a front view of an end face region of the target 10, although an outer heat dissipating element or an outer heat dissipating arrangement 34 in each case is not illustrated but is provided in principle. Instead, a substrate arrangement 28 having two block-shaped substrate elements 30, 32 is once again shown. The latter in each case receive at least one target element 20 between them.

The target elements 20 are embodied in a wire-shaped manner and with a circular cross section and, analogously to the layerlike configuration in accordance with the embodiment shown in FIG. 2, extend along a respective longitudinal axis, not illustrated separately, into the target 10. By this means, a sufficient material volume is again provided in order to compensate for wear and to ensure high heat dissipation proceeding from the focal spot directly into the substrate elements 30, 32. As shown in FIG. 5, the exposed side surface 38 of a target element 20 is thus likewise embodied in a circular fashion. A diameter of the wire-shaped target element 20 thus also defines a thickness D of the target element 20 and of the exposed side surface 38 which is available for irradiation by electrons.

Only one target element 20 is provided in the variant in FIG. 5. The target element is received in a receiving structure 42 in the form of a groove having a rectangular cross section that is open on one side. However, other receiving structures 42 and, in particular, cross-sectional shapes are also conceivable. By way of example, a U-shaped or a V-shaped groove can also be provided. The groove is formed in the lower, first substrate element 30, while the upper, second substrate element 32 shown in FIG. 5 closes the open side of the groove. For this purpose, the substrate elements 30, 32 are pressed against one another analogously to the embodiments above.

Consequently, when an electron beam impinges on the exposed side surface 38, a focal spot size is crucially determined by way of the thickness D of the wire-shaped target element 20. The thickness D can in turn be chosen in such a way that small spot sizes or cross-sectional areas of the emitted X-ray radiation S2 are achievable. By way of example, if the impinging electron beam E has a diameter that exceeds the thickness D, the thickness (or the diameter of the wire-shaped target element 20) correspondingly limits the resulting focal spot 40, as a result of which the spot size of the emitted X-ray radiation S2 is also limited (cf. FIG. 4B). If necessary, target material can be fed by way of the additional material volume of the wire-shaped target element 20 extending into the plane of the drawing.

Although only a single target element 20 is shown in FIG. 5, a plurality of wire-shaped target elements 20 can also be provided, which are preferably arranged within the end face 22 along a common line and preferably parallel to one another. In this case, the target elements 20 can be embodied with an identical thickness D, such that in the event of wear of one of the target elements 20, via realignment of electron beam and target 10, it is possible to change to a different target element 20 that is not yet worn (for example, via the positioning device 26 from FIG. 1).

By contrast, FIG. 6 shows an embodiment in which a plurality of wire-shaped target elements 20 having different thicknesses D1, D2 and D3 of their side surfaces 38 are exposed within the end face 22 of a target 10. Depending on the target element 20 onto which the electron beam is directed, it is thus possible to set a different focal spot size and thus a differently sized cross section of the X-ray beam generated. The exposed side surfaces 38 are arranged next to one another, their upper outer edge points being arranged along a line that runs horizontally in FIG. 6 and is defined by the lower edge of the second substrate element 32. Via suitable dimensions and/or shapes of the receiving structures, what can alternatively be achieved, for example, is that the respective center points of the circular exposed side surfaces 38 lie on a virtual straight line (not illustrated in FIG. 6).

Since the focal spot size is crucially determined by the thickness of the target element 20 in the embodiments shown, the requirements in respect of focusing of the electron beam can also be reduced. By way of example, electron beam focusing that is possibly not highly accurate is likely to affect, rather, an efficiency of the radiation source 1 in the sense of a ratio of the power of the electron beam source 12 to the X-ray radiation obtained. By contrast, the focal spot size remains comparatively stable even in the case of imprecise focusing, such that a substantially constant resolution is achievable. This can be achieved by virtue of the fact that a region of impingement of the electron beam E on the target element 20, which region is possibly too large or too small on account of imprecise focusing, has no effect since the resulting focal spot 40 is predefined and restricted anyway by the thickness D of the target element 20.

It is understood that the foregoing description is that of the preferred embodiments of the invention and that various changes and modifications may be made thereto without departing from the spirit and scope of the invention as defined in the appended claims.

What is claimed is:

1. A target for a radiation source of invasive electromagnetic radiation in the form of X-ray radiation, the target comprising:

a substrate arrangement;

at least one target element including a material which is configured to generate the invasive electromagnetic radiation upon irradiation with particles;

said at least one target element being coupled to said substrate arrangement for conducting heat from said at least one target element;

said at least one target element having a peripheral surface forming a first part of an outer surface of said at least one target element;

said outer surface of said at least one target element being additionally formed by a side surface of said at least one target element;

wherein an extent of the side surface defines a thickness (D) of said at least one target element;

said side surface defining a peripheral line;

said peripheral line forming an edge line of said peripheral surface;

wherein the target has an end face, as part of which said side surface of said at least one target element is arranged in an exposed manner for irradiation with the particles;

said substrate arrangement being in contact with said peripheral surface;

said at least one target element being embodied in a layerlike manner;

said at least one target element having a greater width (B) in comparison with said thickness (D);

said peripheral line having a total length defined by said thickness (D) and by said width (B);

said substrate arrangement being in contact with said peripheral surface at sides thereof which are opposite one another in a direction of said thickness (D); and, said thickness (D) of said at least one target element, embodied in a layerlike manner, increasing at said side surface with increasing extent in a direction of the width (B).

2. The target of claim 1, wherein said peripheral surface is larger than said side surface.

3. The target of claim 1, wherein said at least one target element defines a polygonal outline having different side lengths including a first side length not longer than a longest one of said side lengths; and, said side surface defines said first side length.

4. The target of claim 1, wherein the target comprises a plurality of target elements having different thicknesses (D1, D2, D3), and wherein the side surfaces, arranged in an exposed manner, of said plurality of target elements are arranged along a common line.

5. The target of claim 1, wherein said substrate arrangement encloses said at least one target element at least in portions.

6. The target of claim 1, wherein said substrate arrangement has a first substrate element and a second substrate element, said first substrate element and said second substrate element receiving at least a portion of said at least one target element between them.

7. The target of claim 1, wherein said substrate arrangement is received in a heat dissipating element or a heat dissipating arrangement, which is connected or connectable to a cooling device.

8. The target of claim 1, wherein said substrate arrangement includes at least one of diamond and a diamondlike material and said at least one target element includes tungsten.

9. The target of claim 1, wherein said substrate arrangement includes at least one of diamond and a diamondlike material.

10. The target of claim 1, wherein said at least one target element includes tungsten.

11. A radiation source for generating invasive electromagnetic radiation in the form of X-ray radiation, the radiation source comprising:

a target having a substrate arrangement and at least one target element;

said at least one target element including a material which is configured to generate the invasive electromagnetic radiation upon irradiation with particles;

said at least one target element being coupled to said substrate arrangement for conducting heat from said at least one target element;

said at least one target element having a peripheral surface forming a first part of an outer surface of said at least one target element;

said outer surface of said at least one target element being additionally formed by a side surface of said at least one target element;

wherein an extent of the side surface defines a thickness (D) of said at least one target element;

said side surface defining a peripheral line;

said peripheral line forming an edge line of said peripheral surface;

wherein the target has an end face, as part of which said side surface of said at least one target element is arranged in an exposed manner for irradiation with the particles;

said substrate arrangement being in contact with said peripheral surface;

said at least one target element being embodied in a layerlike manner;

said at least one target element having a greater width (B) in comparison with said thickness (D);

said peripheral line having a total length defined by said thickness (D) and by said width (B);

said substrate arrangement being in contact with said peripheral surface at sides thereof which are opposite one another in a direction of said thickness (D);

said thickness (D) of said at least one target element, embodied in a layerlike manner, increasing at said side surface with increasing extent in a direction of the width (B);

a particle beam source configured to radiate a particle beam onto said target; and a positioning device configured to orient said target and said particle beam relative to one another in a variable manner, such that a surface region of the target onto which the particle beam is directed is variable.

12. A method of operating a radiation source, wherein the radiation source is a radiation source for generating invasive electromagnetic radiation in the form of X-ray radiation and includes a target having at least one target element which is configured to generate invasive electromagnetic radiation upon irradiation with particles and which is coupled to a substrate arrangement for dissipating heat from the target element, wherein the target element has a peripheral surface forming a first part of an outer surface of the target element, wherein the outer surface of the target element is additionally formed by a side surface of the target element, wherein an extent of the side surface defines a thickness (D; D1, D2, D3) of the target element, wherein a peripheral line of the side surface forms a marginal line of the peripheral surface, wherein the target has an end face, as part of which the side surface of the target element is arranged in an exposed manner for irradiation with the particles, and wherein the substrate arrangement is in contact with the peripheral surface, wherein the at least one target element is embodied in a layerlike manner, the at least one target element has a greater width (B) in comparison with the thickness (D), the peripheral line has a total length defined by the thickness (D) and by the width (B), the substrate arrangement is in contact with the peripheral surface at sides thereof which are opposite one another in a direction of the thickness (D); and, the thickness (D) of the at least one target element, embodied in a layerlike manner, increases at said side surface with increasing extent in a direction of the width (B), the radiation source including a particle beam source configured to radiate a particle beam onto the target and a positioning device configured to orient the target and the particle beam relative to one another in a variable manner such that a surface region of the target onto which the particle beam is directed is variable, the method comprising the steps of:

directing a particle beam onto a first surface region of an end face of the target; and, varying a relative orientation of the target and the particle beam in such a way that the particle beam is directed onto a second surface region of the end face of the target; wherein the first surface region of the end face and the second surface region of the end face have regions, having different thicknesses, of exposed side surfaces of one or more target elements of the target.

13. A method for producing a target for a radiation source of invasive electromagnetic radiation in the form of X-ray radiation, comprising:

providing at least one target element which includes a material which is configured to generate the invasive electromagnetic radiation upon irradiation with particles, wherein the target element has a peripheral surface forming a first part of an outer surface of the target element;

bringing the peripheral surface into contact with a substrate arrangement for dissipating heat from the target element, wherein the outer surface of the target element is additionally formed by a side surface of the target element, wherein an extent of the side surface defines a thickness (D) of the target element, and wherein a peripheral line of the side surface forms a marginal line (R) of the peripheral surface, arranging the side surface of the target element in an exposed manner for irradiation with the particles and wherein the side surface forms a part of an end face of the target;

wherein the target element is embodied in a layerlike manner, such that it has a larger width (B) in comparison with the thickness (D);

wherein a total length of the peripheral line is defined by the thickness (D) and by the width (B), wherein the substrate arrangement is in contact with the peripheral surface at sides thereof which are opposite one another in the direction of the thickness (D); and, wherein the thickness (D) of the layerlike target element increases at the side surface with increasing extent in the direction of the width (B).

* * * * *